US006381814B1

(12) United States Patent
Colpo

(10) Patent No.: US 6,381,814 B1
(45) Date of Patent: May 7, 2002

(54) CLASP WITH PLUG FOR ITEMS OF GOLD AND FASHION JEWELLERY SUCH AS BRACELETS, NECKLACES AND SIMILAR

(75) Inventor: Renzo Colpo, Sovizzo (IT)

(73) Assignee: Colpo & Zilio SrL, Torri di Zuartesolo (IT)

( * ) Notice: Subject to any disclaimer, the term of this patent is extended or adjusted under 35 U.S.C. 154(b) by 0 days.

(21) Appl. No.: 09/693,922

(22) Filed: Oct. 23, 2000

(30) Foreign Application Priority Data

Oct. 21, 1999 (IT) ..... VI99A0215

(51) Int. Cl.[7] ..... A44B 11/26

(52) U.S. Cl. ..... 24/611; 24/574.1; 24/68 J; 24/327; 63/3.1

(58) Field of Search ..... 24/574.1, 587.1, 24/596.1, 611, 68 J, 69 J, 327, 633, 644, 647; 403/321, 326, 327

(56) References Cited

U.S. PATENT DOCUMENTS 4,170,809 A * 10/1979 Geldwerth et al. ..... 24/230 R
4,532,682 A * 8/1985 Murao ..... 24/616
5,231,740 A * 8/1993 Mohebkhosravi ..... 24/616
5,327,619 A * 7/1994 Ortega ..... 24/625
5,522,529 A * 6/1996 Yurman et al. ..... 224/176
5,653,009 A * 8/1997 Kassardjian ..... 24/667
6,058,576 A * 5/2000 Harris ..... 24/265 EC

* cited by examiner

*Primary Examiner*—Anthony Knight
*Assistant Examiner*—A. Jackson
(74) *Attorney, Agent, or Firm*—Dykema Gossett PLLC

(57) ABSTRACT

A clasp (1) for bracelets, necklaces and similar items has a female element and a male element fastened together by a plug belonging to the male element that fastens in a corresponding hole in the female element by a locking belong to an extending member. The extending member has a protruding actuator end and a first part held in a first seat of the plug, which has a fork at its end created by two arms spread apart that meet to create a seat that encloses across a fixed pin set crossways through the first seat of the plug. The plug has an opening to introduce a tool suited to closing the arms rotating around the fixed pin.

14 Claims, 7 Drawing Sheets

CLASP WITH PLUG FOR ITEMS OF GOLD AND FASHION JEWELLERY SUCH AS BRACELETS, NECKLACES AND SIMILAR

BACKGROUND OF THE INVENTION

The invention concerns a clasp with plug especially suited to being applied to gold or fashion jewellery such as for instance bracelets, necklaces, chains and similar.

As is known one type of clasp that is frequently applied to items of gold and fashion jewellery is often called a "plug clasp".

This basically comprises a female element provided with first means of attaching to a first end of one of said items, which has a hole that receives a plug belonging to a male element provided with second means of attaching to the second end of the same item.

The firm yet detachable coupling of the plug of the male element within the corresponding hole in the female element, is achieved by one or more extending members that are made to flex by elastic devices and are provided with means of locking suited to connecting with corresponding means of striking belonging to the female element.

Known plug clasps of the type described above, in comparison to other known kinds of clasp, have the advantage of offering greater reliability against accidental opening. What's more they can be made in any shape whatsoever suited to being integrated with the shape of the item they are applied to.

These clasps do nevertheless have a limitation in that the extending members and the elastic devices they work with, are all enclosed within the plug of the male element and consequently the plug cannot be produced in sizes smaller than a given minimum limit governed by the coexistence inside of the extending members and the elastic devices.

As a result, known types of plug clasp cannot be used on any items, such as necklaces or bracelets, which are somewhat small in cross-section since this would ruin the overall aesthetic appearance of these items.

To overcome these limitations and inconveniences, the depositee of this invention has registered under the same name the Italian patent for industrial invention having deposit number V196A000064 which describes an improved type of plug clasp that against equivalent, known types of plug clasp has markedly smaller cross-sectional dimensions.

To be more precise the clasp comprises a female element and a male element provided with a plug that can be fastened in a corresponding hole in the female element.

The male element contains a flexibly extending member externally operated by an actuator end, provided with means of locking that connect with corresponding means of striking belonging to the female element when the plug is fastened in the hole of the female element.

The extending member is basically L-shaped and sits in a cavity made in the body of the male element, which ends with a well that holds the shaped end of the extending member.

A pivot point is thereby created that allows the extending member to rotate when the user presses it from the outside on the actuator end.

A spring inserted in the body of the male element, having one end connected to the male element and its opposite end restrained within a hole made in the extending member, provides the latter with a flexing movement.

Together with its flexing function, the spring also performs the function of travel stop that limits the movement of the extending member while it rocks to open or close the clasp. The clasp described above has however some limitations and inconveniences.

A first inconvenience is the difficulty found when producing the well that holds the end of the extending member in the body of the male element.

Another inconvenience is the need to produce the hole in the extending member that holds the end of the elastic device. Last but not least an inconvenience is the lack of a genuine travel stop that allows to limit the rocking of the extending member inside the seat that holds it.

SUMMARY OF THE INVENTION

This invention intends to overcome these limitations and inconveniences.

In particular a first scope of the invention is to produce a plug clasp that is simpler to produce than the clasp under the aforementioned patent.

Another scope is that the clasp of the invention should also have a greater precision in its operation. Last but not least a scope is that the clasp invention be easier to assemble than similar, equivalent clasps.

Said scopes are achieved by producing a clasp for gold and/or fashion jewellery items such as bracelets, necklaces and similar that in accordance with the main claim comprises:

- at least one female element and at least one male element fastened by means of attaching each to its respective end of one of said adornments;
- a plug belonging to the body of said at least one male element, suited to being fastened in a corresponding hole in said at least one female element;
- an extending member basically shaped in the form of an L that comprises a first part fitted in a first seat made lengthways in said plug and a second part fitted in a second seat made in the body of said male element and provided with means of locking suited to snapping onto corresponding means of striking belonging to said female element when said plug is fastened in said hole;
- a shaped end belonging to said second part and protruding from the body of said at least one male element that acts as the actuator piece for the user to operate;
- at least one elastic device inserted between said extending member and the body of said male element, and wherein the end of said first part of said extending member has a fork created by two arms spread apart that meet to create a seat suited to being closed across a fixed pin set crossways through said first seat of said plug, the latter being provided with an opening for introducing a tool suited to closing said arms rotating around said fixed pin.

According to a preferred form of execution, the second part of said extending member consists of a flat sheet metal body whose end is shaped to provide the fork.

The fork is created by two arms spreading apart in a V-shape that meet to create a basically ringed sectioned seat that will couple around the outside of a pin, which also has a basically ringed cross-section.

When the fork's arms are closed by bending, achieved for instance by pliers that are introduced through the opening made in the end of the plug, the extending member remains coupled rotating around the plug.

The elastic devices consist of a coil spring restrained between the second part of the extending member and the body of the male element.

The body of the male element also has a slot from which protrudes an adjustable striking element suited to limiting the movement of the extending member inside said plug.

An advantage obtained from the clasp is that it is easier to produce since the plug does not have blind spots.

Another advantage is that the particular forked construction of the end of the extending member and the way by which it is coupled rotating around the pin, allows greater precision in the clasp's operation.

BRIEF DESCRIPTION OF THE DRAWINGS

An additional advantage is that the existence of an adjustable travel stop contributes towards improving the clasp's operation. Said scopes and advantages shall be better explained during the description of a preferred form of execution of the invention that is given as a guideline but not a limitation with reference to the attache diagrams, where.

DESCRIPTION OF THE INVENTION

Figures 1, 2:
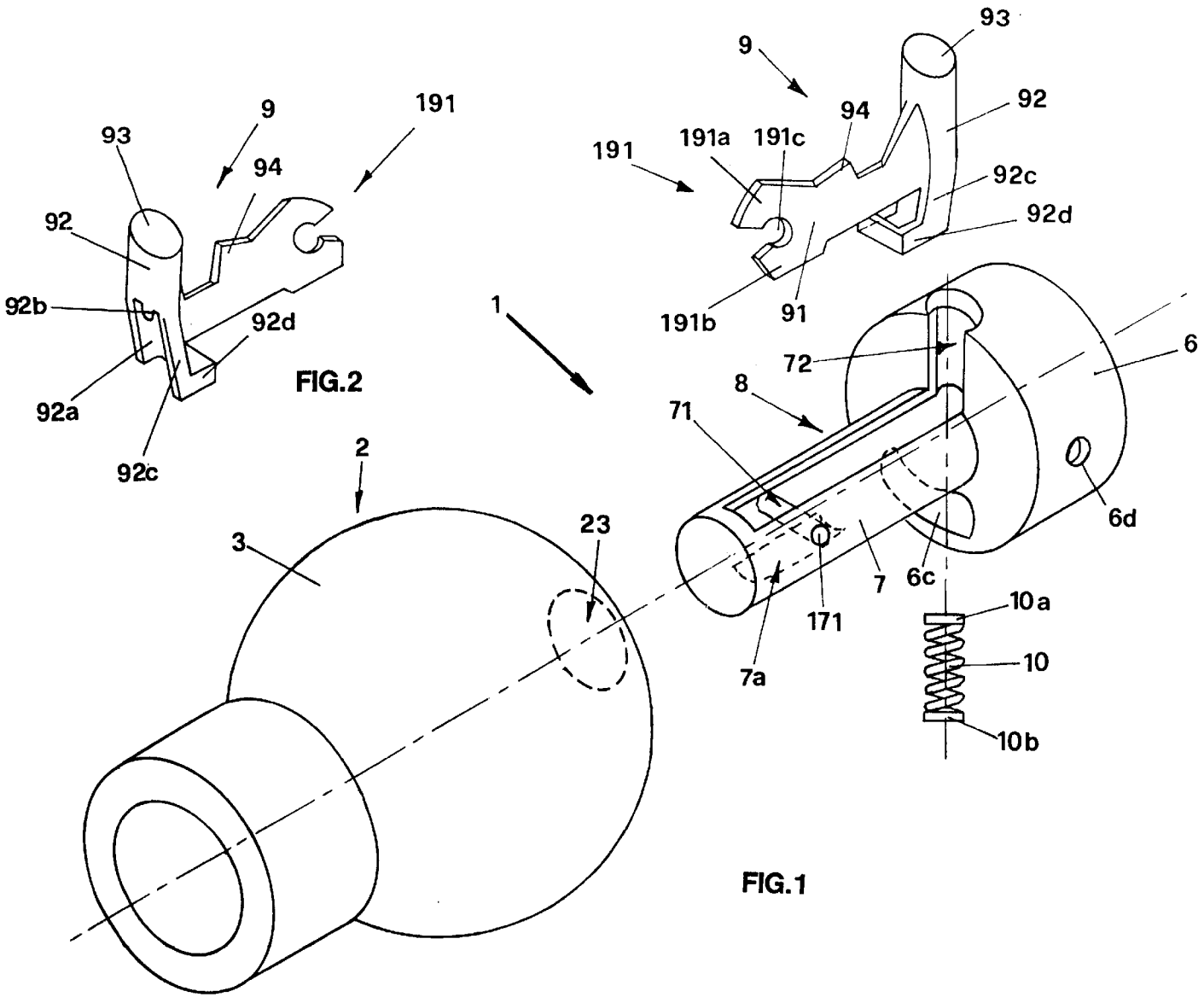
FIG. 1 shows the clasp invention in a blow-up isometric illustration.
FIG 2 shows the detail of a part of the clasp illustrated in FIG. 1.

As can be seen in FIG. 1 the clasp invention, generally indicated by 1, comprises:

- a female element, generally indicated by 2, whose body 3 is attached by first means of attaching (not illustrated) to a first end of an adornment, for instance a bracelet or a necklace (not illustrated);
- a male element, generally indicated by 5, whose body 6 is attached by second means of attaching (not illustrated) to a second end of the same adornment.

The male element 5 also comprises a basically cylindrically shaped plug 7, coaxial to its body 6, provided with a cavity 8, made partly in the plug 7 and partly in the body 6, suited to receiving an extending member, generally indicated by 9, made flexing by inserting one or more springs 10.

To be more precise it can be seen, also in FIGS. 3, 4, 5 and 6, that the aforesaid cavity 8 comprises a first seat 71 made in the plug 7 suited to holding a first part 91 of the extending member 9 and a second seat 72 made in the body 6 of the male element 5, suited to holding a second part 92 of the same extending member 9.

The two parts 91, 92, are basically perpendicular to one another so that the extending member 9 is given a basically L-shaped structure.

Under the invention the end of said first part 91 of said extending member 9 has a fork 191 created by two arms 191*a*, 191*b* spread apart that meet to create a seat 191*c* suited to being closed across a fixed pin 171 set crossways through said first seat 71 of said plug 7.

In particular the plug 7 consists of a hollow cylindrical section with a longitudinal slot 7*a*, designed for introducing a tool suited to closing said arms 191*a*, 191*b* rotating around said fixed pin 171.

Preferably but not necessarily the first part 91 of the extending member 9 consists of a flat sheet metal body while the second part 92 consists of a basically cylindrically shaped body.

At the end of the flat sheet metal body, which represents the first part 91, a fork 191 has been made that is basically V-shaped with its arms 191*a*, 191*b* set spreading apart from the seat 191*c* that links them together.

The seat 191*c* has a basically ringed section suited to coupling around the outer surface of the pin 171 that also has a ringed cross-section.

Figure 4:
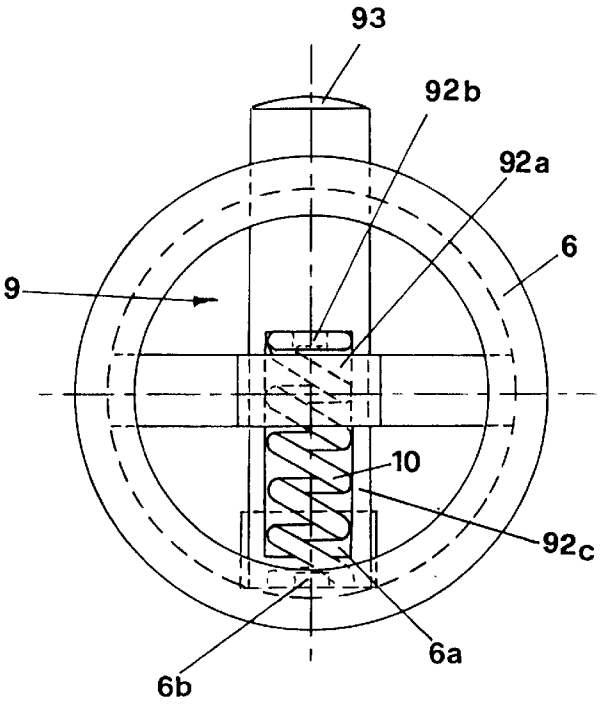
FIG. 4 shows a cross-section of the clasp in FIG. 3 made along line III—III
Figure 3:
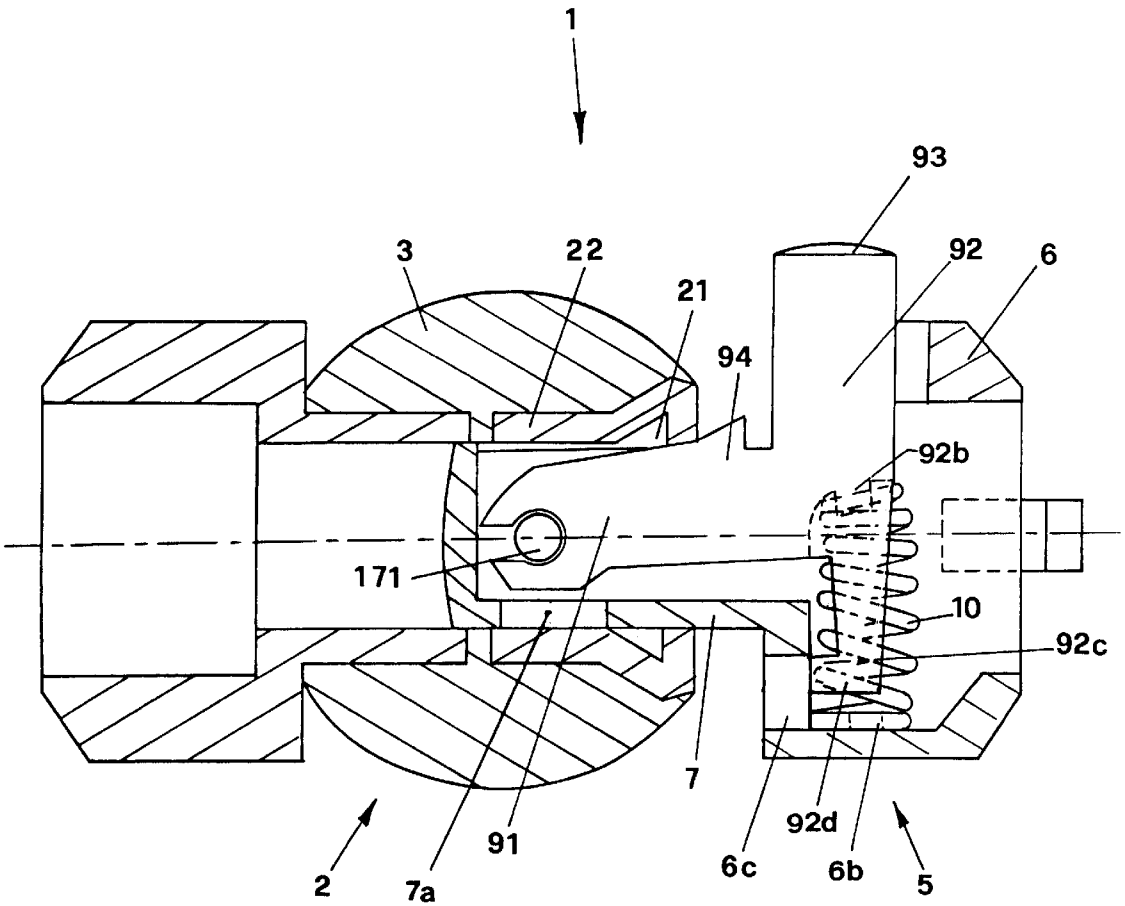
FIG. 3 shows a longitudinal section of the clasp in FIG. 1, assembled and with the plug being inserted in the female element.

The spring 10 that allows the flexing movement of the extending member 9, is a coil type spring which, as can be seen in detail in FIGS. 2, 3 and 4, has a first end 10*a* that is held in a corresponding recess 92*a* made in the second part 92 of the extending member 9 and a second end 10*b* that is held in a second recess 6*a* made in the body 6 of the male element 5.

The spring is kept in place within the respective recesses by lug elements 92*b*, 6*b* that fit into corresponding ends 10*a*, 10*b* of the spring.

The extending member 9 also has means of locking consisting of a tine 94 that connects against corresponding means of striking that consists of a ringed recess 21, that can be seen in detail in FIG. 3, which belongs to a sheath 22 inserted in the body 3 of the female element 2 and provided with a hole 23 that receives the plug 7 to fasten it to the female element 2.

It can also be seen that one end of the second part 92 of the extending member 9 has an actuator end 93 that juts out of the body 6 of the male element 5 and on its opposite end a buckling attachment 92*c* with a lip 92*d* that is set in to face a slot 6*c* made in the body 6 when the extending member 9 is fitted in the cavity 8.

The body 6, as can be seen in FIG. 1, has a through going hole 6*d* that allows a tool, for instance an awl, to be introduced to bend the attachment 92*c* in order to adjust the entry of the lip 92*d* in the slot 6*c*.

In this way, as can be seen in FIG. 3, the end 92*d* becomes the travel stop that limits the flexing rotation of the extending member 9 around the pin 171 in the cavity 8 and also prevents them from coming apart.

In practise to attach the male element 5 to the extending member 9, the latter has to be inserted in the cavity 8 and using a tool, for example needle-nose pliers, through the longitudinal slot 7*a* of the plug 7, the ends 191*a*, 191*b* of fork 191 can be accessed to be bent and closed rotating around the pin 171, obtaining the coupling as shown in FIG. 3.

Figure 5:
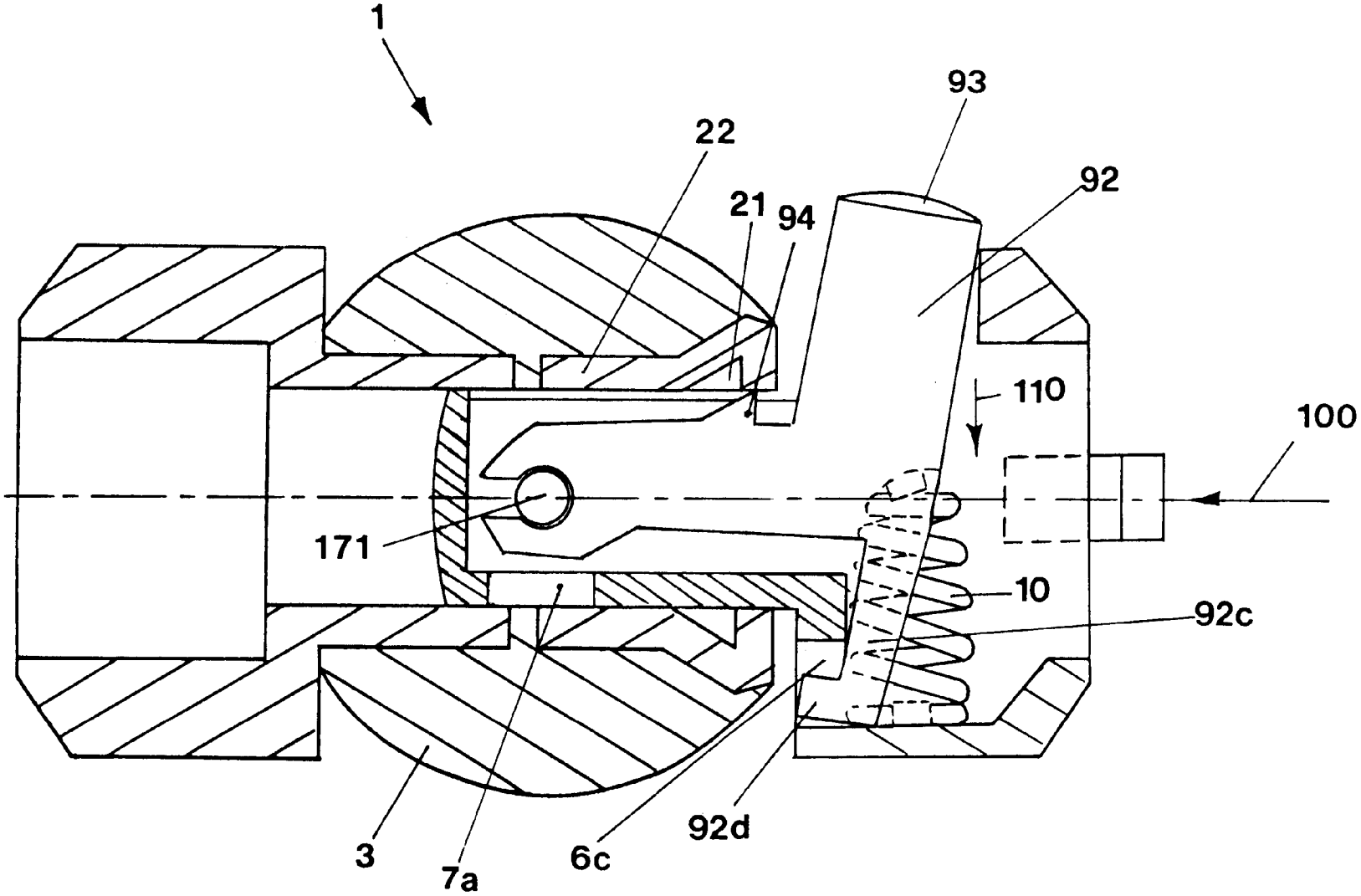
FIG. 5 shows the clasp in FIG. 3 while the plug is being inserted in the female element.
Figure 6:
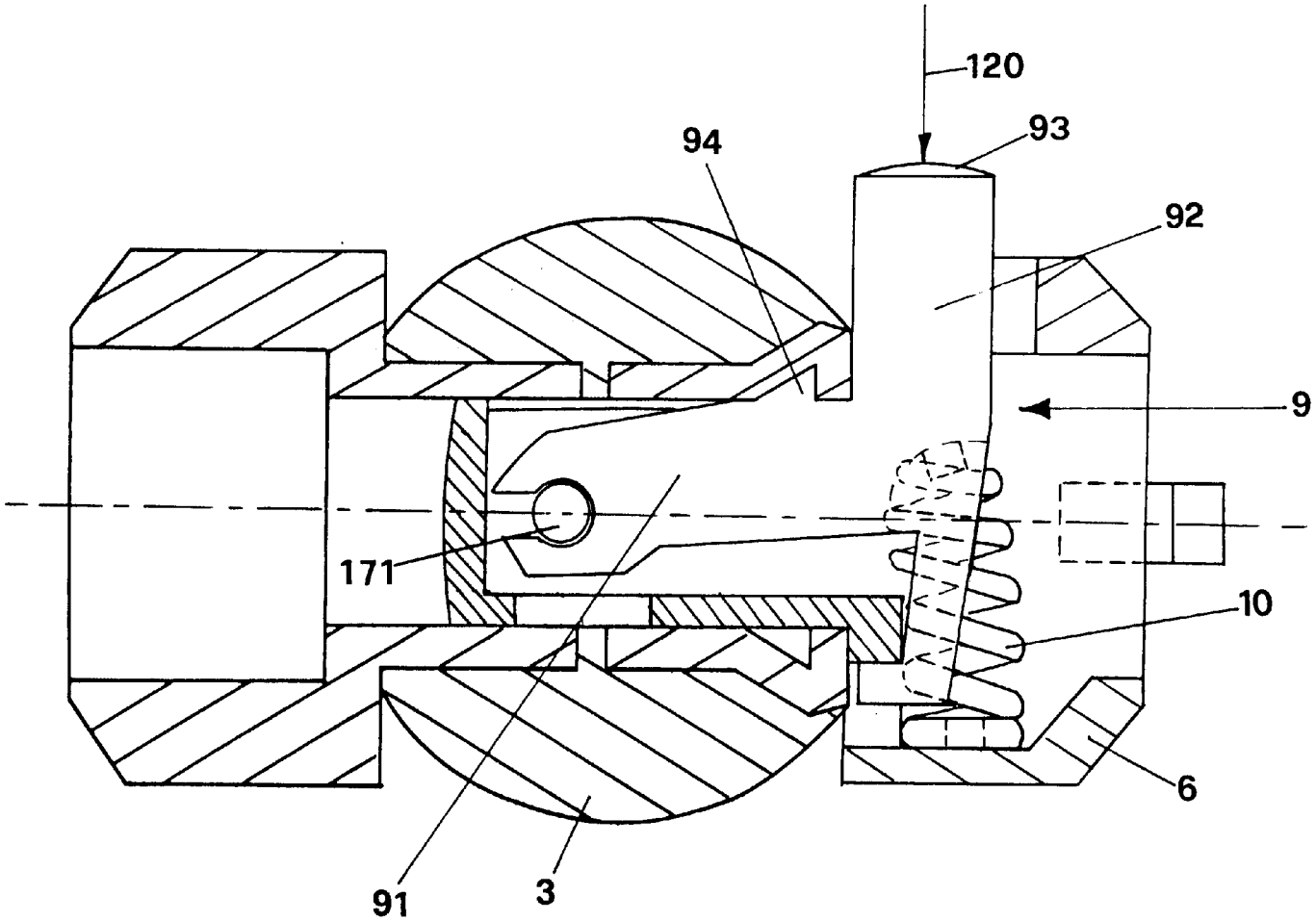
FIG. 6 illustrates the clasp in FIG. 3 assembled.
Figure 8:
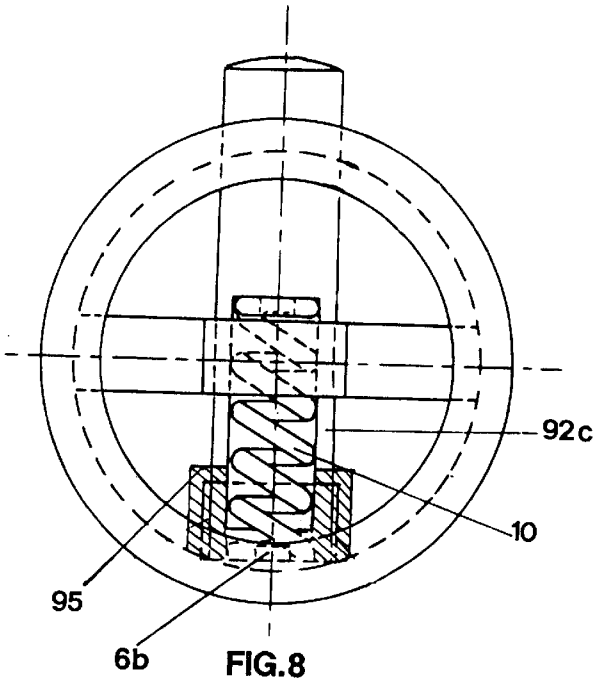
FIG. 8 illustrates another view of the variant in execution in FIG. 7.

Then the spring 10 is inserted between the extending member 9 and the body 6 of the male element 5 and using a tool, for instance an awl, which is introduced through hole 6*d*, the attachment 92*c* is bent setting it at an angle as can be seen in FIG. 5 so that the lip 92*d* is set inside the slot 6*c* where it acts as travel stop as can be seen in FIG. 6.

In this way the extending member 9 remains locked onto the male element 5, with the possibility of flexing outwards by a distance checked by the lip 92*d* in the slot 6*c*.

To join the element making up the clasp, the plug 7 of the male element 5 is inserted in the hole 23 of the female element 2 as can be seen in FIG. 3 and then, by applying an longitudinal pressure 100 as illustrated in FIG. 5, the tine 94 is pushed against the rim of the sheath 22. This compresses the spring 10 and lowers the extending member 9 in direction 110.

If the axial pressure 100 is continued the tine 94 enters the ringed recess 21 and the extending member 9 returns to its initial position by the elastic recoil of the spring 10.

As a result the layout illustrated in FIG. 6 is obtained where the male element 5 and the female element 2 are fastened together.

To open the clasp it is sufficient to press on the actuator end 93 of the extending member 9 with a pressure 120 directed downwards, as can be seen in FIG. 6, until the elastic force of the spring 10 is overcome and release the tine 94 from the ringed recess 21.

Then by pulling outwards the elements are separated.

It should be noted that the elasticity of the extending member 9 allows the male element 5 to be fastened onto the female element 2 simply by pushing both towards each other without the need to press on the actuator end 93 of the extending member 9, thereby facilitating the process of fastening the two elements.

A variant in execution of the clasp invention is illustrated in FIGS. 7 to 10 where it can be seen that it differs from the previous form of execution by the existence inside the body 6 of the male element 5 of a sloping face 95 set beneath the lip 92*d* of the buckling attachment 92*c*, in line with the lug element 6*b* that restrains the spring 10.

Figure 7:
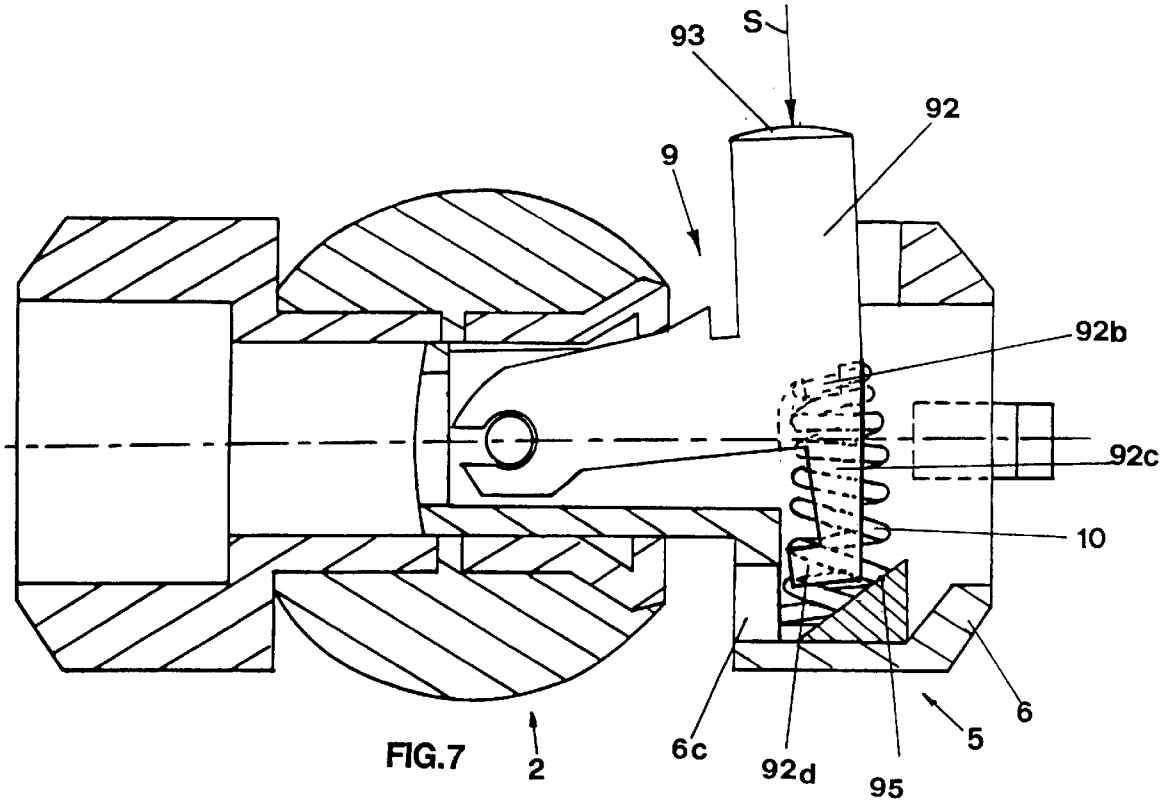
FIG. 7 illustrates a part of a variant in execution of the clasp invention.

As can be seen in FIG. 7, when the extending member 9 is in its idle position and in other words pushed upwards and set at an angle by the action of the spring 10, the lip 92*d* of the buckling attachment 92*c* is set against the sloping face 95.

Figure 9:
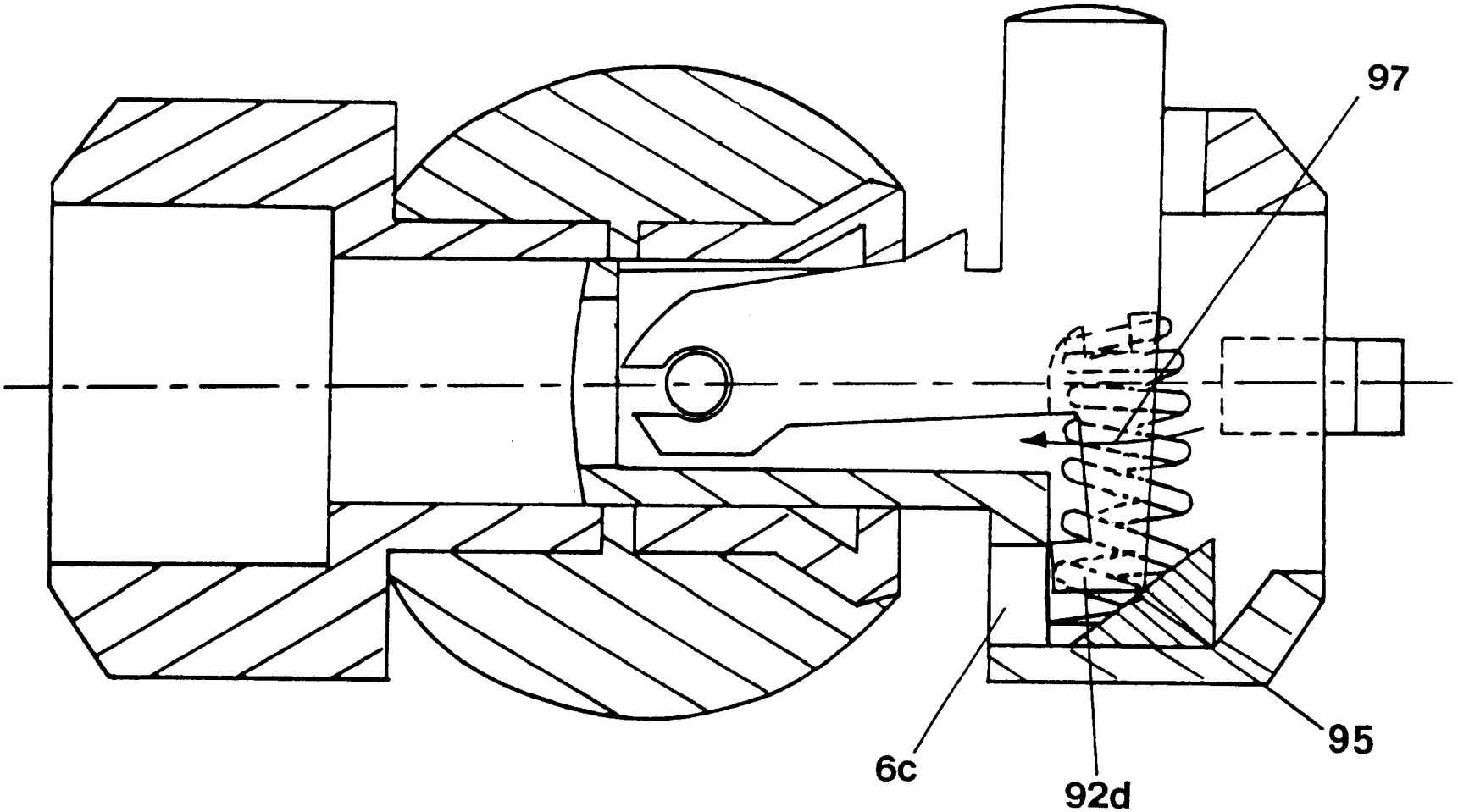
FIGS. 9 and 10 illustrate different conditions of the variant in execution illustrated in FIG. 7.

If the user pushes the extending member 9 downwards by applying a pressure S on the actuator end 93, the action of the lip 92*d* against the sloping face 95 makes the buckling attachment 92*c* flex, bending in the direction of rotation indicated by arrow 97 in FIG. 9 thereby making the lip 92*d* enter the slot 6*c*.

Figure 10:
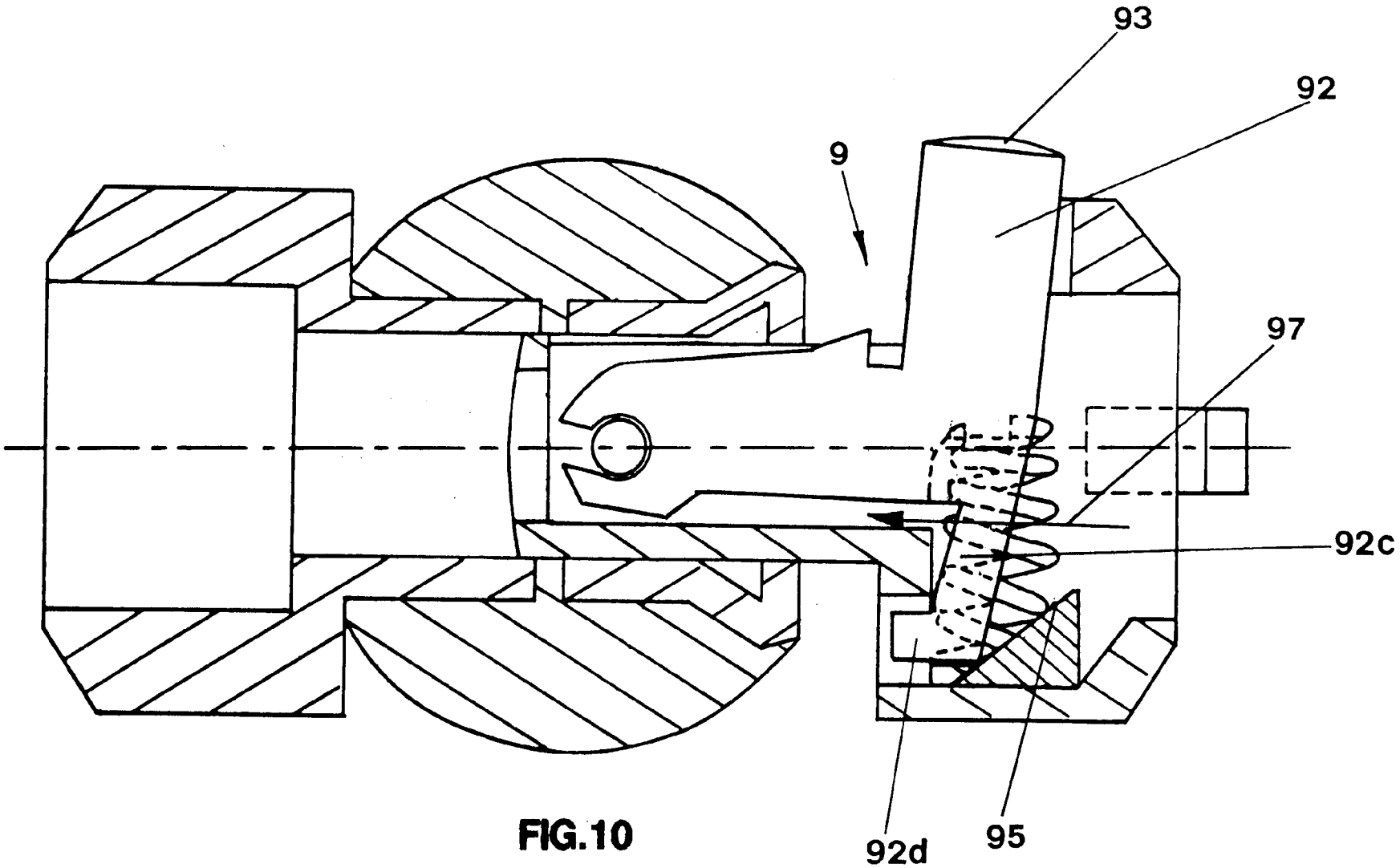

If the downward pressure on the extending member 9 continues, the buckling attachment 92*c* continues to bend until the final set-up illustrated in FIG. 10 where it reaches its bent limit and therefore total entry of the lip 92*d* in the slot 6*c*.

In this variant in execution the side hole 6*d* is no longer necessary for introducing a tool to bend the buckling attachment 92*c* since this is bent automatically the first time the extending member 9 is actuated.

In this way in addition to avoiding the need to make a hole in the male element 5, the need to bend the attachment 92*c* during assembly is also eliminated.

It is quite understandable that the clasp invention in both the forms of execution that have been illustrated is easy to produce since the extending member 9, and in particular its first part 91 and the fork 191 together with the tine 94, can be produced by simple die-cutting processes.

Even the use of a tubular section to produce the plug 7 simplifies the manufacturing process.

What's more even the assembly operations are simplified and the clasp offers reliable operation given the existence of travel stops.

It is clear that during actual production, the elements that make up the clasp may change in shape and obviously also in dimension, which may be of any form or size.

These variants and any others that may be applied to the clasp under this invention, since they fall under the claims given below, shall all be held covered by this patent.

What is claimed is:

1. A clasp for jewelry items such as bracelets, necklaces and the like, having ends comprising:

a female element and a male element fastened by means of attaching each to respective ends of one of said items;

a plug belonging to the body of said at least one male element, suited to being fastened in a corresponding hole in said at least one female element;

an extending member shaped in the form of an L, which comprises a first part fitted in a first seat made lengthways in said plug and a second part fitted in a second seat made in the body of said male element and provided with means of locking suited to snapping onto an opening in said female element when said plug is fastened in sale hole;

a shaped end belonging to said second part and protruding from the body of said male element that acts as the actuator piece for the user to operate;

at least one elastic device inserted between said extending member and the body of said male element;

wherein the end of said first part of said extending member has a fork created by a pair of arms spread apart that meet to create a seat suited to being closed across one fixed pin set crossways through said first seat of said plug, said plug being provided with an opening for introducing a tool suited to closing said pair of arms rotating around said fixed pin.

2. The clasp according to claim 1 wherein said first part of said extending member comprises a flat sheet metal body whose end is shaped to provide said fork.

3. The clasp according to claim 1 wherein said fork basically has a V shape created by said pair of arms, spreading apart from a common meeting point where they create said seat that has a basically circular section.

4. The clasp according to claim 1 wherein said plug comprises a tubular element.

5. The clasp according to claim 1 wherein said second part as a cylindrical shape.

6. The clasp according to claim 1 wherein the side face of said body of said male element has a through hole therein.

7. The clasp according to claim 1 wherein said body of said male element has a second recess suited to receiving a second end of said elastic device.

8. The clasp according to claim 1 wherein said at least one elastic device comprises a coil spring.

9. The clasp according to claim 1 wherein said locking means comprises a tine made in said first part of said extending member.

10. The clasp according to claim 1 wherein said means of striking comprises a ringed recess belonging to a sleeve inserted in the body of said female element and provided with a hole suited to receiving said plug lengthways.

11. The clasp according to claim 1 wherein the second part has an end located opposite said shaped end, said second part of said extending member has a buckling attachment with a lip pointed towards a slot made in the body of said male element.

12. The clasp according to claim 11 wherein inside said body of said male element there is at least one sloping face that works against said lip of said buckling attachment.

13. The clasp according to claim 1 wherein said second part of said extending member has a recess suited to receiving a first end of said at least one elastic device.

14. The clasp according to claim 13 wherein each of said recesses contains a lug element suited to fitting into a corresponding end of said elastic device to restrain it.

* * * * *